US005370037A

United States Patent [19]

Bauer et al.

[11] Patent Number: 5,370,037

[45] Date of Patent: Dec. 6, 1994

[54] CONTROL VALVE MEANS

[76] Inventors: Joachim Bauer, Hugo-Klemm-Strasse 8, D-21075 Hamburg; Klaus Albrecht, Bickbüschen 19, D-23843 Bad Oldesloe; Rolf Krahmer, Hagener Allee 102, D-22926 Ahrensburg, all of Germany

[21] Appl. No.: 153,296

[22] Filed: Nov. 16, 1993

[30] Foreign Application Priority Data

Dec. 2, 1992 [DE] Germany ..... 9216386

[51] Int. Cl.[5] ..... F01L 15/00; F15B 15/17

[52] U.S. Cl. ..... 91/236; 91/274; 91/321; 91/415

[58] Field of Search ..... 91/415, 417 R, 417 A, 91/47, 51, 461, 235, 246, 264, 272, 274, 321

[56] References Cited

U.S. PATENT DOCUMENTS

| | | | |
|---|---|---|---|
| 3,255,674 | 6/1966 | Nelson et al. | 91/417 R |
| 3,547,003 | 12/1970 | Ramspeck | 91/321 X |
| 3,685,396 | 8/1972 | Obergfell | 91/417 A X |
| 4,716,813 | 1/1988 | Prudencio | 91/417 A X |

FOREIGN PATENT DOCUMENTS

0326639B1 7/1988 European Pat. Off. .

*Primary Examiner*—Edward K. Look
*Assistant Examiner*—Hoang Nguyen
*Attorney, Agent, or Firm*—Vidas, Arrett & Steinkraus

[57] ABSTRACT

The present invention relates to a valve control apparatus for operating a working piston, comprising a main valve spool including a smaller piston face subjected to compressed air from a reservoir and a larger piston face facing a main control space, further comprising an auxiliary valve spool having a first effective area which can be connected by a trigger valve to atmosphere or to a compressed air reservoir to displace the main control spool into an open position, and having a second effective area which is connected to a piston stroke chamber for displacing the main valve spool into a closed position, wherein the auxiliary valve spool is returned when the pressure acting on its second effective area falls below a predetermined value, wherein this effective area is connected to a shift valve which communicates with atmosphere when the trigger is not actuated and which is closed when being actuated and wherein the trigger is provided to move a first length of travel and a second length of travel to actuate the shift valve, while the trigger valve is maintained to be activated, wherein the shift valve has a tappet which closes an outlet opening connecting the second effective area to atmosphere when the tappet is moved over an open position and wherein the tappet is moved beyond the open position when the trigger is moved a second length of travel, and wherein the tappet is biased towards the open position.

24 Claims, 3 Drawing Sheets

Fig. 1
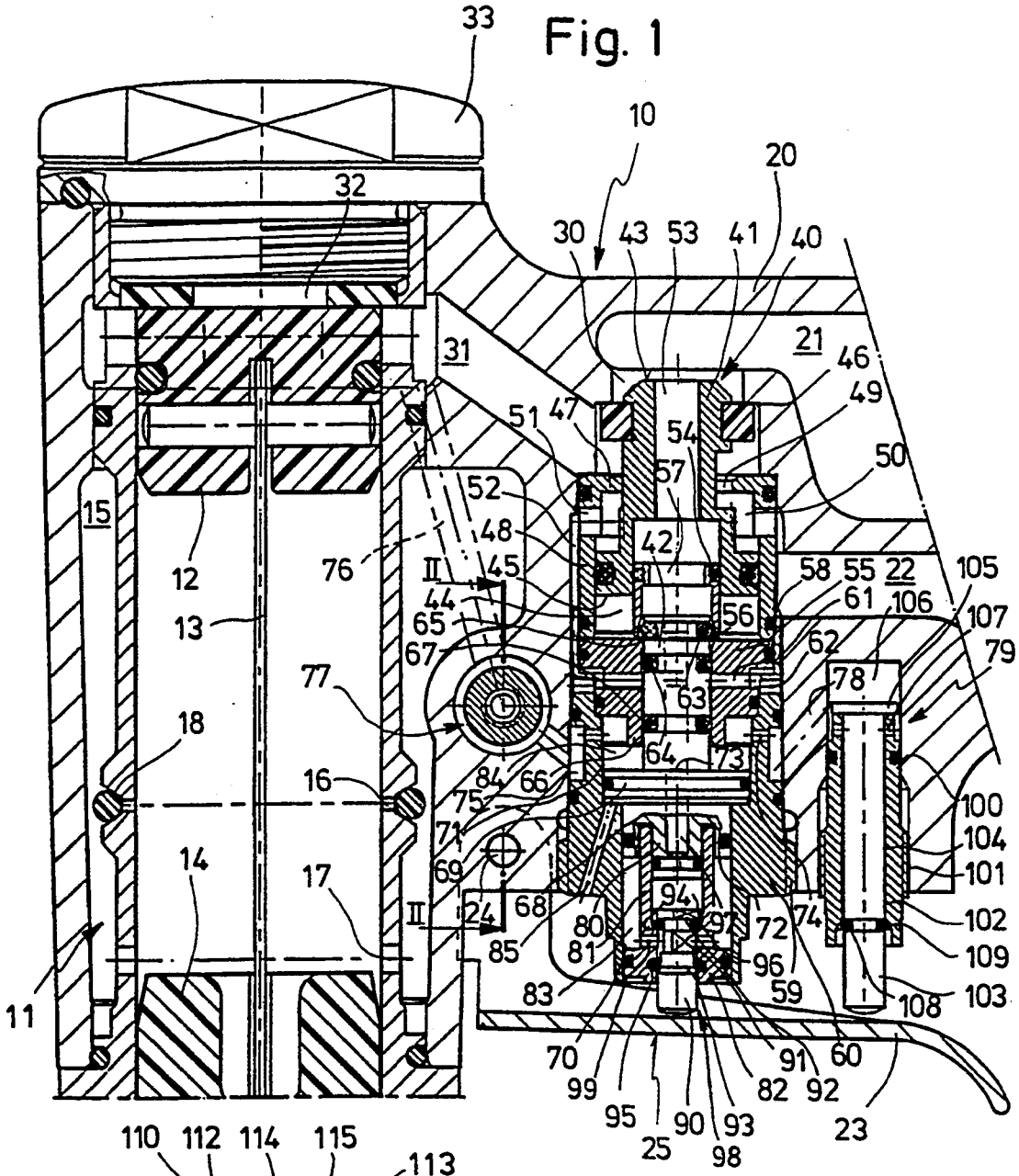
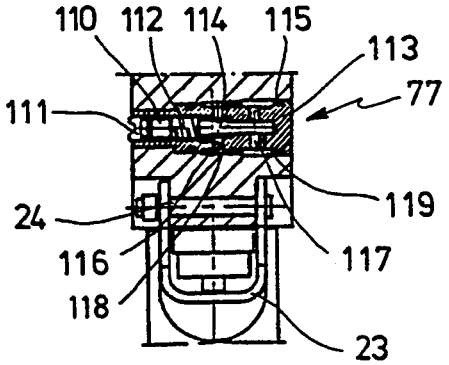
Fig. 2

CONTROL VALVE MEANS

BACKGROUND OF THE INVENTION

The present invention relates to a control valve means for pressurized air-operated devices for driving fasteners into a workpiece.

A control valve means of this type is disclosed in EP-B 0 326 639. The device comprises an auxiliary valve spool having a second effective area communicating with a bore which is directed towards a trigger lever and which is connected to atmosphere when the trigger lever is in an inactive position. A portion of the trigger lever supports a sealing element sealingly closing the bore when the trigger lever is actuated. The sealing element is made of an elastomer and has a plug-like shape including a tappet tip at one end. It seats in the bore of an adjusting screw which in turn is provided in a threaded bore of the trigger lever.

When the trigger lever of this valve control means is actuated to move a first length of travel, a trigger valve which is defined by a plunger valve is released. This results in a single strike operation. When the release lever is further moved a second length of travel, the sealing element closes the bore and the device works in an automatic operation. There is the drawback that the release lever must be held in a position to maintain the automatic operation, in which position the conical tip of the seal element seals the opening. This requires a certain force resulting in a relatively clinched grip. This means vibrations are relatively intensively transmitted to the hand of the operator. There is a further drawback that the release lever has an offset portion adjacent the seal element such that the rearward grip portion only can be grasped with some comfort. The hand seizes the device adjacent the center of gravity which is located closer to the cylinder, thus the hand is ergonomically not particularly well positioned. There is a further drawback that repair and service of the valve control means are relatively expensive as a great number of components has to be disassemblied. In addition to the trigger lever, a valve plate including a throttle must be removed. Accordingly, a number of coaxially mounted components of the valve control means such as the main valve spool, the auxiliarly valve spool and the control sleeve as well as further parts adjacent the release lever become disassembled. As a rule, however, only those components which are dynamically strained in the automatic operation are required to be repaired or serviced. Again, reassembling the device including less stressed components is expensive.

SUMMARY OF THE INVENTION

With a view to this it is the object of the present invention to improve the control valve means with respect to the handling features thereof.

The object referred to is solved by the features of claim 1, while further features of the present invention are defined by the subclaims.

According to the invention, the shift valve is defined as a plunger valve which allows for a certain additional actuating stroke after being actuated. Consequently, some additional length of travel of the release lever can be performed, when the lever is actuated for single shot operation as well as for automatic operation, all this resulting in a less stiff grip and a relatively resilient and relaxed handling of the driving device. This also means that the hand of the operator experiences much less vibration.

A further ergonomic advantage is seen in the fact that handling space below the release lever is saved by the arrangement of the shift valve adjacent the coaxial arrangement of main valve spool, auxiliary valve spool and control sleeve such that the lever may be formed relatively flat. Consequently, it can be seized by the operator relatively close to the cylinder such that the device can be seized below its center of gravity.

Particularly useful for repair and service is the combination of all components dynamically stressed in the automatic operation to define a control valve cartridge (module) which unit can be assembled and disassembled by means of a threaded portion without disassembling parts such as the throttle or the shift valve which require less maintenance. This has the additional advantage that a throttle adjustment determining the working frequency of the device can be maintained, and the device must not be readjusted when it is assembled again.

Still further, any dead times are lessened due to the interconnections between the second effective area of the auxiliary valve spool and the stroke chamber through a passage including the throttle, which dead times would occur when the passage is connected to the piston return space. This is useful when an increase of the repetitious frequency of the device is desired.

The foregoing and other objects, features and advantages of the present invention will become apparent in the light of the following detailed description of an exemplary embodiment thereof, as illustrated in the accompanying drawing.

BRIEF DESCRIPTION OF THE DRAWINGS

FIG. 1 is a sectional view of the control valve means in the inactive position;

FIG. 2 is a sectional view taken along line II—II in FIG. 1 in a reduced scale;

DESCRIPTION OF THE PREFERRED EMBODIMENT

Figure 3:
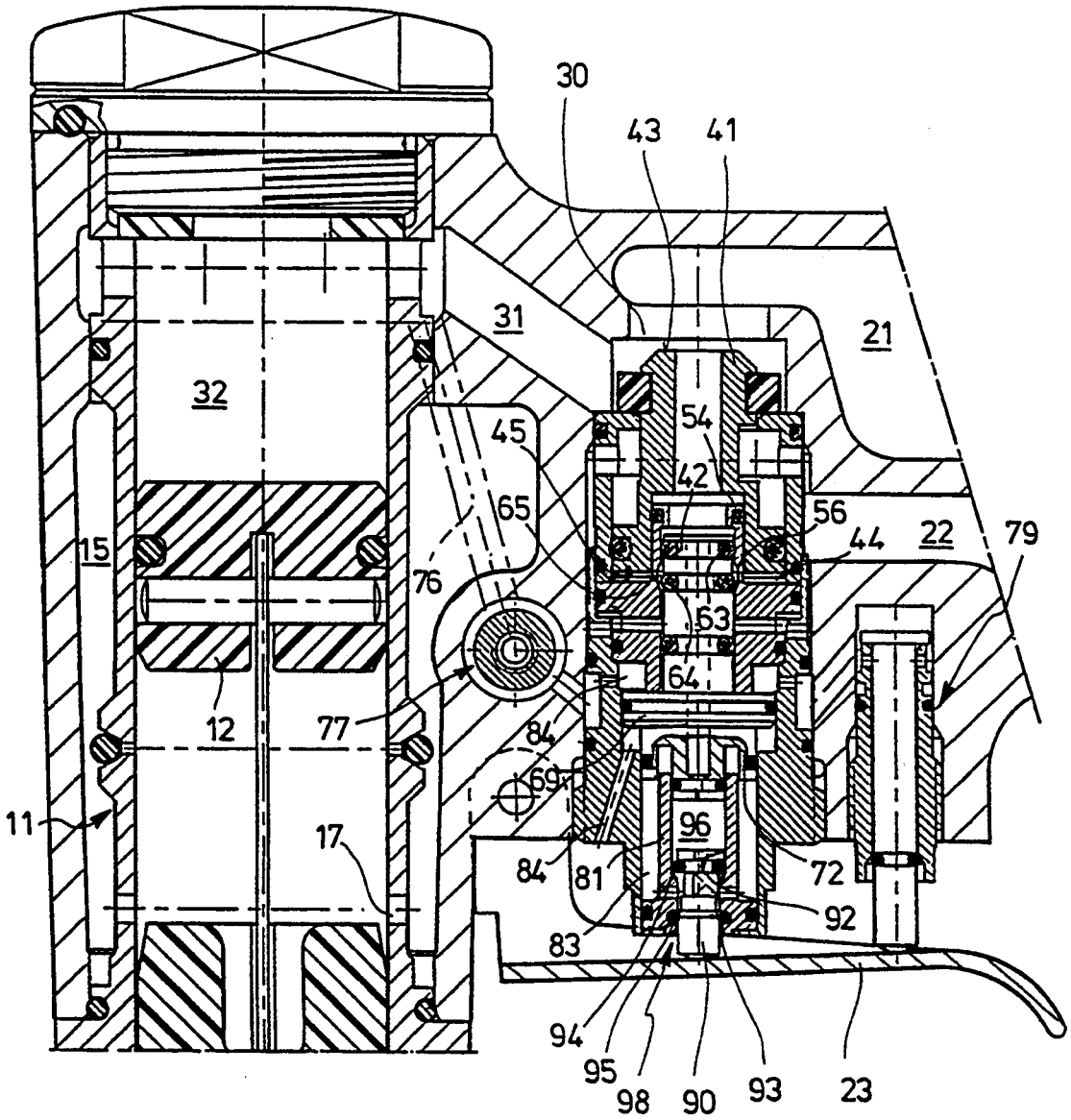
FIG. 3 is a sectional view of the same control valve means ready for single shot operation.

The driving tool of which a part-sectional view is shown in FIGS. 1 to 4 comprises a housing 10 and a working cylinder 11 which receives a working piston 12 which is connected to a driving ram 13. A brake ring 14 is arranged at the lower end of the working cylinder 11. The working cylinder 11 is surrounded by a piston return chamber 15 which is connected to the working cylinder 11 through first radial bores 16 and second radial bores 17. The bores 16 are closed by an O-ring 18 at the end facing the return chamber 15, thus forming a check valve.

The housing 10 includes a gripping portion 20, wherein a reservoir 21 for compressed air is formed. The reservoir 21 for example is connected to a source of compressed air through an air hose. Further, a vent passage 22 is formed in the gripping portion 20. At the lower side of the gripping portion 20 there is supported a one-armed trigger lever 23. This lever includes a pivotal bearing 24 on the housing 20 close to the working cylinder 11. The one-armed trigger lever 23 is bent downwardly towards its free end, but has a substantially plane contact face 25.

A bore 30 in the gripping portion 20 communicates with a passage 31 which leads to a working stroke chamber 32 of the cylinder 11. The working stroke chamber 32 is closed by a lid plug 33 from above. The bore 30 interconnects the reservoir 21 and the passage 31 and extends within the housing 20 up to an opening above the trigger lever 23. The bore 30 receives a control valve module 40. It includes a main valve spool 41 and an auxiliarly valve spool 42. The main valve spool 41 is designed as a stepped piston having an effective area 43 at one end facing the reservoir 21 and a larger effective area 45 in opposition thereto facing a main control chamber 44. The piston portion of the main valve spool 41 including the smaller effective area 43 comprises a relatively voluminous seal ring 46 having a rectangular cross-section. When the tool is not activated, the upper front face of the ring 46 cooperates with an upper valve seat whereby the interconnection between the reservoir 21 and the passage 31 is blocked. The lower front face of the ring 46 cooperates with an inwardly projecting sealing edge 47 of a sleeve 48 which is sealingly received in the bore 30. The piston portion of the main valve spool having the larger effective area 45 is slidably and sealingly guided in the bore of the sleeve 48. There is a gap 49 between the main valve spool 41 and the sleeve 48 connecting the passage 31 to an inner space 50 of the sleeve when the main valve spool is positioned as shown in FIG. 1. The inner space 50 is located at the side of the larger piston portion of the main valve spool 41 remote from the main control chamber 44, and is continuously connected through radial bores 51 and an annular collecting passage 52 around the control valve module to the vent passage 22. Consequently, the working stroke chamber 32 is subjected to atmospheric pressure.

Through the main control spool 41 a central bore 53 extends having an enlarged portion receiving the upper end of a control sleeve 54. This includes a radial flange 55 which is sealingly held from outside. The control sleeve 54 comprises a number of radial bores 56 interconnecting a central bore 57 of the control sleeve 54 with the main control chamber 44.

The main control chamber 44 is thus confined by the control sleeve 54, the sleeve 48 and the larger effective area 45 of the main control spool 41. As shown, the sleeve 48 and the flange 55 of the control sleeve 54 are sealingly engaged in a stepped recess 58 of a support ring 59. The support ring 59 is received in the bore 30 and held therein by an outer threaded portion 60. Communicating bores 61, 62 of the flange 55 and the support ring 59 open into the annular groove 52 connecting the bores 57 of the control sleeve 54 to atmosphere.

The bore 57 of the control sleeve 54 receives the upper cylindrical portion of the auxiliary valve spool 42 in forming an annular gap. The top portion of the auxiliary valve spool has a pair of spaced O-rings 63, 64. In the position of the auxiliary valve spool shown in FIG. 1, the upper O-ring 63 is located in an annular groove 65 of the control sleeve 54 into which the radial bore 56 open. Between the O-ring 63 and the annular groove 65 there is a gap interconnecting the radial bores 56 and the bores 57 and 53 so that the main control chamber 44 communicates with the reservoir 21. The lower O-ring 64 sealingly engages the bore 57 of the control sleeve 54 between the radial bores 56 and 61 so that the passage from the radial bore 56 through the bores 61, 62 and the annular passage 52 to the vent passage 22 is interrupted.

The flange 55 of the control sleeve 54 includes a downwardly suspending extension 66 in which the upper cylindrical portion of the auxiliary valve spool 43 including an O-ring 67 is sealingly guided. Below it the auxiliary valve spool 52 comprises a first and a second piston portion 68, 69 which are sealingly guided in first and second bores 70, 71 of the support ring 59. The first and second piston portions 68, 69 include effective areas 72, 73 wherein the second effective area is larger than the first one. The second effective area 73 faces the main valve spool 41 and the first effective area 72 is in opposition thereto. The second bore 71 is connected through radial bores 74 to an annular passage 75 of the support ring 59. The annular passage 75 is connected through a passage 76 including a throttle 77 to the working stroke chamber 32 on the one hand and through a channel 78 to a shift valve 79 on the other hand. The throttle 77 and the shift valve 79 will be explained below.

The first piston portion 68 is cup-shaped and comprises a first effective area 72 facing away from the main valve spool 40. A third piston portion 80 of the auxiliary valve spool 42 is centrally located which piston portion faces away from the main valve spool 41 as well. The third piston portion 80 is sealingly guided in a trigger valve sleeve 81 extending between the third and the first piston portion 68 and positioned through a radial flange 82 in sealing engagement with the support ring. Thus, the trigger valve sleeve 81 including the radial flange 82, the first bore 70 and the first piston portion 68 confine a first auxiliary control space 83, whereas a second auxiliary control space 84 is confined by the second piston portion 69, the second bore 71 and the flange 55. On the face of the second piston portion 69 facing away from the second control space 84 the bore 71 is connected to atmosphere through a vent passage 85.

A trigger tappet 90 is mounted in the trigger valve sleeve 81 the tappet having radial play with respect to the sleeve. On either side of a restriction 91 having a polygonal cross-section the release tappet 90 has sealing faces 92, 93. The release valve sleeve 81 includes sealing faces 94, 95 mating therewith, wherein O-rings are arranged between the complementary sealing faces. The sealing faces 92, 93 of the tappet 90 are spaced far theraway from each other than the sealing faces 94, 95 of the trigger valve sleeve 81 so that a small axial mobility of the tappet 90 is provided when considering the position of the O-rings therebetween. In the position of FIG. 1 the sealing surface 92 is sealed with respect to the sealing face 94 through the upper O-ring so that a cavity 96 between the third piston portion 80, the release valve sleeve 81 and the tappet 90 is closed. The cavity 96 is connected through a central bore 97 extending through the auxiliary valve spool as well as the bore 57 and 53 to the reservoir 21. The release valve sleeve has radial bores 98 in the area of the restriction 91 of the tappet 90 which bores open into the first auxiliary control space 83. In the position of the tappet 90 shown in FIG. 1, the auxiliary control space 83 is connected through the bores 98 and the annular gap between the tappet and the release valve sleeve 81 to atmosphere as the sealing faces 93, 95 as well as the O-ring therebetween release a vent opening.

The main valve spool 81, the auxiliary valve spool 42, the control sleeve 54 and the release valve 98 including the tappet 90 and the release valve sleeve 81 are combined with the support ring 59 to define a control valve module 40 which as a unit can be screwed into the bore 30 or, respectively, removed therefrom. The shift valve 79 is received in an adjacent bore 100 in which it is held by the threaded portion 101 of a sleeve 102. The shift valve 79 comprises a tappet 103 arranged in the sleeve 102, wherein an annular gap 104 is formed between the sleeve and the tappet. The inner end of the tappet 103 forms an enlarged head 105 which rests on the inner front face of the adjusting sleeve 102 as shown in FIG. 1. Above the head 105, a cavity 106 of the bore 100 is provided which communicates with the passage 78 and into which cavity the head 105 can slide. The bore 100 continuously communicates through radial bores 107 of the sleeve 102 with the annular gap 104 between the tappet 103 and the sleeve 102. The tappet 103 further includes a lower O-ring 108 cooperating with a tapered sealing face 109 of the sleeve 102. According to FIG. 1 an outlet opening is provided between the O-ring 108 and the tapering sealing surface 109 which outlet opening may be closed by displacing the tappet 103 further into the bore 100. The opening position of the tappet 103 shown is automatically obtained, when there is compressed air in the cavity 106 driving the tappet outwardly. In the opening position shown, however, the second auxiliary control space 84 is connected to atmosphere through the passage 78, the bore 100, the radial bores 107, the annular gap 104 and the outlet opening.

For details of the throttle 77 it is referred to FIG. 2. Accordingly, the throttle 77 comprises a throttle needle 110 and a screw head 111 which is mounted adjustable in length to a threaded portion 112 in a throttle sleeve 113. The throttle needle 110 has a weakly tapered throttle tip 114 which is adjustable in an cylindrical bore 115 of the throttle sleeve 113. On either side of the cylindrical bore 115 there are radial bores 116, 117 of the throttle sleeve 113 which open into outer annular grooves 118, 119 of the throttle sleeve 113 which are connected to each one of a pair of portions of the passage 76 accomodating this throttle 77. By axial adjusting the needle 110 in the throttle sleeve 113, the flow gap between the throttle tip 114 and the bore 115 can be varied, whereby the flow rate between the annular gaps 118 and 119 is adjusted.

The control valve means referred to operates as follows.

FIG. 1 illustrates the non-actuated state. The trigger lever 23 is shown in a non-actuated position in which it is held by a spring means not shown. In this position the trigger lever is spaced from the tappets 90, 103 of the trigger valve 98 and the shift valve 79. The cavity 96 is continuously connected to the reservoir 21 so that the trigger tappet 90 is resiliently biased in the position shown. In this open position of the trigger valve 98 the auxiliary control space 83 is connected to atmosphere as already explained. Also the shift valve 79 is in the open position so that the second auxiliary control space 84 is also connected to atmosphere. The one end face of the auxiliary valve spool 42 is subjected to air pressure within the bore 57 and the other end face thereof is subjected to air pressure within the cavity 96, thus being maintained in the position shown, as the end face first referred to is larger than the second end face. Consequently, the O-rings 93, 94 of the auxiliary valve spool 42 are located with respect to the control sleeve 54 such that the main control space 44 is connected to the reservoir 21. This in turn forces the main control spool 41 into the position shown in which the main control spool in combination with the seal ring 46 closes the working stroke chamber 32 off the reservoir 21 for connecting it to the vent passage 22. The working piston 12 being sealed with respect to the cylinder 11 is thus maintained in its upper end position.

Referring to FIG. 3, when the trigger lever 23 is pivoted about a first length of travel, the inner side of the lever pushes against the tappet 90 of the trigger valve 98 moving it deeper into the trigger valve sleeve 81. Finally, the sealing faces 93, 95 seal against each other and the seal between the sealing faces 92, 94 is released. Consequently, the connection of the auxiliary control space 83 to atmosphere is interrupted and a connection with the cavity 96 which is subjected to compressed air from the reservoir 21 is effected. The compressed air in the first auxiliary control space 83 is supplied to the first effective area 72 of the auxiliary valve spool 42 which is displaced towards the main valve spool 41. The second auxiliary control space 84 is still connected to atmosphere through the non-actuated shift valve 79 so that the second effective area 73 does not counteract the movement of the auxiliary valve spool 42 into the position shown. The size of the first effective area 72 is determined such that it overcomes the counterforce resulting from the pressurized end faces having different sizes when subjected to compressed air. During each movement of the auxiliary valve spool 42, the vent bore 85 provides for a pressure compensation of the stroke volume on the side of the second piston portion 69 facing away from the second auxiliary control space 84.

In this position of the auxiliary valve spool 42 the upper O-ring 63 seals the annular gap between the cylindrical portion of the auxiliary valve spool and the control sleeve 54 with respect to the reservoir 21, and the lower O-ring 64 has moved into the area of the annular groove 65 of the control sleeve 54. Consequently, the main control space 44 is connected through the radial bore 56, the annular groove 65 and the annular gap between the auxiliary valve spool 42 and the control sleeve 54 with the radial bores 61, 92 and the annular passage 52 with the vent passage 22. The compressed air from the reservoir 21 still acts on the smaller effective area 43 of the main valve spool 43 to displace it into the position shown. Compressed air from the reservoir 21 flows through the bore 30 and the passage 31 into the working chamber 32 and displaces the working piston 12 downwardly. At the same time compressed air flows through the passage 76 and the throttle 77 into the second auxiliary control space 84 in which no pressure can build up which could return the auxiliary valve spool 42 into its rest position as the shift valve 79 is still open to atmosphere. However, when the trigger lever 23 is released, it returns into its rest position shown in FIG. 1 wherein the tappet 90 is also returned into its open position by the compressed air in the cavity 96. Then the first auxiliary control space 83 vents through the outlet opening of the trigger valve 98 and the pressure acting on the first effective area 72 of the auxiliary valve spool 42 falls to atmospheric pressure. Because of the differently sized faces at either end of the auxiliary valve spool 42, the compressed air acting on the auxiliary valve spool results in a force acting in the direction of the tappet 90 so that the spool returns into its rest position shown in FIG. 1. Then the main control space 44 is disconnected from atmosphere via the O-ring 64 and the main control space 44 is connected to the reservoirs 21 when the O-ring 93 engages the annular group 65. Then pressurized air again acts on the larger effective area 45 and the smaller effective area 43 of the main valve spool 41 which is thus returned into its rest position shown in FIG. 1 in which the working chamber 32 is disconnected from the reservoir 21 and is connected to the vent passage 22. The air entering the piston return chamber 15 through the radial opening 17 returns the driving piston 12 into its rest position.

Figure 4:
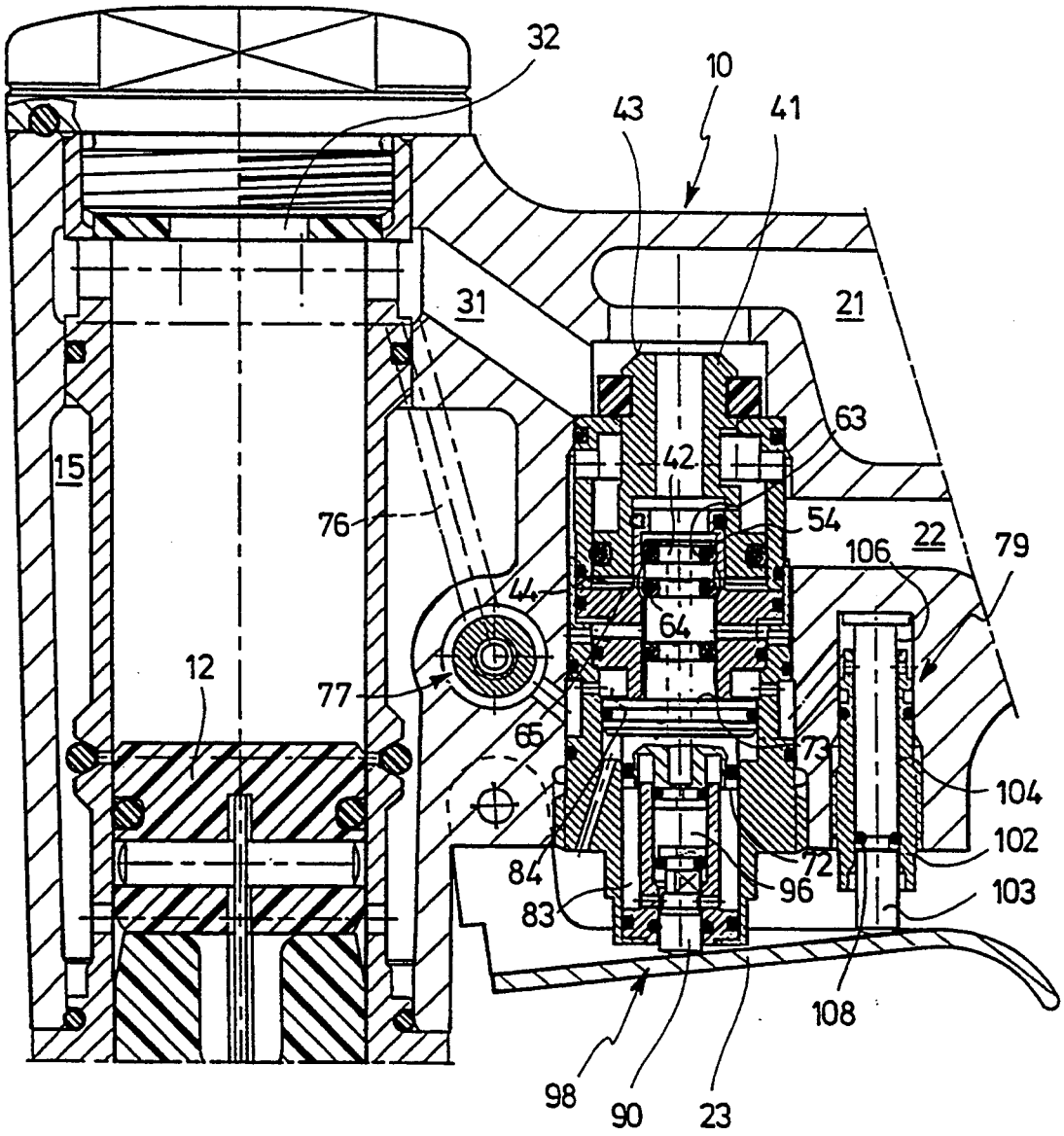
FIG. 4 is a sectional view of the same control valve means ready for automatic shot operation.

If it is desired that the control valve means operates as an automatic valve for continuous operation, the trigger lever 23 has to be pivoted at least into a second position with respect to the housing 10 as shown in FIG. 4. The second pivotal position is characterized in that the O-ring 108 of the tappet 103 sealingly rests on the bore of the adjusting sleeve 102 to close the gap 104 between the tappet and the adjusting sleeve. When the second position is thus reached, pressurized air in the second auxiliary control space 84 cannot flow off through the passage 78 and the shift valve 79 so that the air pressure in the second auxiliary control space increases. When the trigger lever 23 is actuated to at least travel the second length of actuation, the same operations are repeated as they have been performed in the single shot operation when the lever has been actuated to at least move the first length of travel up to releasing the trigger lever. Here it makes no difference whether the trigger lever 23 is first moved to travel the first length of travel and then to move the second length of travel after having conducted a first shot or is directly moved to travel into the second position right away. However, when the second position is obtained, the air pressure gradually increases in the second auxiliary control space 84 via the passage 76 and the throttle 77 after the main valve spool 41 has been displaced into the open position. Increasing the air pressure depends on the throttle adjustment. The pressure additionally acts on the auxiliary valve spool 42 towards the tappet 90. The size of the second effective area 73 and the pressure increase are determined such that the additional force displaces the auxiliary valve spool 42 towards the tappet 90 against the force resulting from the pressure acting on the first effective area 72 and unisonous with the force resulting from the pressure acting on both the end faces. By this, the O-ring 64 is again brought into sealing position at the inner wall of the control sleeve 54 and the O-ring 63 is displaced into the annular groove 65 so that the connection of the main control space 54 to the vent passage 22 is interrupted and the main control space is connected to the reservoir 21. This again results in moving the main control spool 41 into the closed position in which the connection between the reservoir 21 and the passage 31 is closed and the passage 31 is connected to the vent passage 22. In returning the piston 12 the air in the cylinder space above the piston flows off through the vent-passage 22.

In connecting the passage 31 to atmosphere through the vent passage 22, the pressure in the second auxiliary control space 84 is reduced through the passage 76 and the throttle 77 and the force pushing the auxiliary valve spool 42 towards the tappet 90 is decreased. As soon as the piston 12 has reached its upper dead point position, the pressure in the second auxiliary control space 84 falls to a value such that the pressure acting on the first effective area 72 in opposition to the force resulting from the pressure acting on both the front faces thereof return the auxiliary valve spool 42 into its upper position in which the connection of the main control space 44 to the reservoir 21 is interrupted and the main control space is connected to the vent passage 22. Then the main valve spool opens and a new working cycle of the piston 12 is initiated. The working cycles are repeated as long as the trigger lever 23 is maintained actuated in the second position. The provision of the tappets 90 and 103 for the trigger valve 98 and the shift valve 79 makes it possible that the trigger lever 23 can be further pivoted thus facilitating the handling of the driving tool. However, when the trigger lever 23 is released, the tappets 90, 103 are urged outwards of the sleeve 81 or, respectively, the threaded sleeve 102 by the pressure acting in the cavity 96, 106 until the connection of the first auxiliary control space 83 and the second auxiliary control space 84 to atmosphere is opened. Consequently, the pressure acting on the first effective area 72 and the second effective area 73 falls to atmospheric pressure so that both ends of the auxiliary valve spool 42 are subjected to compressed air alone. Therefore the auxiliary valve spool is moved towards the tappet 90 so that the main control chamber 44 is disconnected from the vent passage 22 and is connected to the reservoir 21. Accordingly, the main control spool 41 returns into its closed position and the passage 31 is disconnected from the reservoir 21 to be connected to the vent passage. Compressed air from the piston return chamber 15 then returns the working piston 12 into its upper dead point position.

We claim:

1. A control valve means for a pressurized air-operated device for driving fasteners into a workpiece, comprising:

a working piston for effecting individual or continuous working cycles;

a piston return chamber for effecting a return stroke of the working piston, wherein a working cycle consists of a single working stroke of the piston for driving a fastener, followed by a return stroke);

a pressure-controlled stepped main valve spool arranged in a pressure and vent passage connected to a working stroke chamber, the main valve spool having a smaller area and a larger area, wherein the smaller area of the main valve spool faces a pressurized air reservoir and the larger area thereof faces a main control space which is alternately pressurized and vented for controlling continuous working cycles;

a slidable stepped auxiliary valve spool movable coaxial of said main valve spool, the stepped auxiliary valve spool having a first effective area and an opposite second effective area, wherein the first effective area of said auxiliary valve spool is selectively connected to atmosphere or to said pressurized air reservoir by means of a trigger valve having a trigger, wherein the trigger valve supplies a control pulse for shifting the auxiliary valve spool into a first axial position in which the main control space is connected to atmosphere for shifting the main valve spool into an open position, and wherein the opposite second effective area of said auxiliary valve spool is connected to a passage being connected to a working chamber of the piston, through which passage a reverse pulse is supplied for shifting said auxiliary valve spool into a second axial position, in which the main control space is connected to said pressurized air reservoir for shifting said main valve spool into a closed position, wherein the auxiliary valve spool is returned into the first axial position by the pressure of the pressurized air reservoir when the pressure acting on said second effective area thereof falls below a predetermined value, wherein the second effective area of said auxiliary valve spool is connected to a shift valve which is associated to the trigger of said trigger valve, the shift valve being connected to atmosphere when the trigger is in an inactive position and the shift valve being sealingly closed when said trigger means is activated, and wherein said shift valve and said trigger valve are designed such that for actuating said trigger valve the trigger is moved further a second length of travel, while said trigger valve remains activated, said shift valve comprises a tappet slidably arranged to displace said trigger, whereby said tappet closes an outlet port of said shift valve connecting said second effective area of said auxiliary valve spool to atmosphere, said tappet being passed over the open position, and that said trigger displaces said tappet beyond said open position when the trigger travels second length and that said tappet is resiliently biased for returning to the open position.

2. The control valve means of claim 1, further comprising a tappet guide means, wherein at least a longitudinal gap is provided between said tappet and said tappet guide means, wherein the longitudinal gap communicates with said second effective area of said auxiliary valve spool and wherein the longitudinal gap opens into an outlet port, and wherein a seal ring is positioned on said tappet, being moved into a position closing said outlet port between said tappet and said tappet guide means when said tappet is passed over said open position.

3. The control valve means of claim 1, wherein said tappet extends into a hollow space communicating with said second effective area of said auxiliary valve spool.

4. The control valve means of claim 2, wherein said tappet guide means includes an enlargement for receiving said seal ring in the open position.

5. The control valve means of claim 1, further comprising a tappet guide means and an adjusting sleeve, wherein said tappet guide means is formed in the adjusting sleeve which in turn is screwed into an adjusting thread portion.

6. The control valve means of claim 1, further comprising a fixed step, wherein said tappet includes a head which limits the movement of said tappet towards said trigger by resting on the fixed step.

7. The control valve means of claim 5, wherein said adjusting sleeve comprising a cross-bore adjacent an end stop, said cross-bore connecting said longitudinal gap to a passage leading to said second effective area.

8. The control valve means of claim 1, wherein said trigger is defined to be a pivotal lever comprising a trigger surface for actuating the shift valve and a pivotal support, and wherein said shift valve is located further away from the pivotal support of said lever than said trigger valve.

9. The control valve means of claim 1, wherein a stationary control sleeve sealingly engages a central bore extending through said main valve spool, said main control space being confined by the control sleeve by a radial flange and includes radial bores opening into said main control space, wherein said auxiliary valve spool is guided in a central control sleeve bore defining an annular gap with sides, and wherein the side of the annular gap facing away from said main control spool includes a passage to atmosphere, characterized in that said radial bores open into a concentric annular groove of said control sleeve bore, and that said auxiliary valve spool is provided with a first and a second axially spaced seal ring, wherein in the first axial position of said auxiliary valve spool said first seal ring facing the passage to atmosphere engages said annular groove exposing a flow passage to said connecting passage, and wherein said main valve spool further comprises a through-bore, and wherein said second seal ring rests on said control sleeve bore sealing said annular gap with respect to the through-bore of said main valve spool, and wherein in the second axial position of said auxiliary valve spool, the one seal ring facing said main valve spool engages said annular groove exposing a flow passage towards the through-bore of said main valve spool, while the other seal ring rests on said control sleeve bore sealing said annular gap with respect to said passage to atmosphere.

10. The control valve means of claim 1, further comprising a stationary control sleeve which sealingly engages a central bore extending through said main valve spool, wherein said first effective area of said auxiliary valve spool is defined by a first spool portion facing away from said main valve spool, the first spool portion being sealingly guided in a first auxiliary control chamber which is connected to atmosphere when the trigger valve is not activated and which is connected to said reservoir when said trigger valve is actuated, wherein said second effective area of said auxiliary valve spool is defined by a second spool portion facing towards said main valve spool, the second spool portion being sealingly guided in a second auxiliary control space chamber of said piston.

11. The control valve means of claim 10, further comprising a concentrical support ring having a recess and a first and second bore, wherein said control sleeve comprises a second flange, the flange being received in the recess of the concentrical support ring and wherein said first and said second spool portions are sealingly guided in first and second bores of said support ring.

12. The control valve means of claim 10, wherein said control sleeve further comprises a radial flange, and wherein said radial flange and said support ring include radial bores, and wherein the radial bores of said ring open into an annular passage leading to atmosphere.

13. The control valve means of claim 10, wherein said control sleeve further comprises a radial flange, said radial flange having an extension at the side remote from said main valve spool and within said extension an annular seal of the auxiliary valve spool is sealingly guided.

14. The control valve means of claim 13, further comprising a support ring, wherein said support ring includes radial bores in the region of said sleeve extension and externally has an annular supply passage communicating therewith which is connected to the working chamber of said piston.

15. The control valve means of claim 10, wherein said trigger valve comprises a slidable trigger tappet arranged to move in the adjusting direction of said trigger, whereby the trigger tappet closes a vent opening of the trigger valve connecting said first effective area of said auxiliary valve spool to atmosphere when passing over an open position, and which opens a pressurized air opening of said trigger valve connecting said first effective area to a pressurized air source, wherein said trigger displaces said tappet to pass over the open position when being actuated to move said first length of travel and wherein said trigger tappet is resiliently biased for moving towards the open position.

16. The control valve means of claim 15, wherein said trigger tappet further comprises portions of increased diameter having sealing surfaces on either side, wherein said trigger tappet is received in a trigger valve sleeve, said trigger valve having sealing surfaces corresponding to the sealing surfaces of the trigger tappet forming a first corresponding sealing surfaces and a second corresponding surfaces, wherein said sealing surfaces of the trigger valve sleeve have a smaller axial distance from each other than said sealing surfaces of said trigger tappet such that the corresponding sealing surfaces can be brought into sealing engagement with each other by an axial displacement of said tappet, wherein said first corresponding sealing surfaces are associated to said vent opening connecting them to atmosphere and wherein the second corresponding sealing surfaces are associated to said pressurized air opening of said trigger valve, and wherein an annular gap between said trigger tappet and said trigger valve sleeve is connected to the radial bores of said trigger valve sleeve, said radial bores being connected to said first effective area of said auxiliary valve spool.

17. The valve control means of claim 16, wherein the tappet has an end, said end being associated to said pressurized air opening and extendable into a hollow space subjected to pressurized air.

18. The control valve means of claim 10, wherein the trigger valve, the main valve spool and the auxiliary valve spool have and axis, said trigger valve being coaxial with said main valve spool and said auxiliary valve spool.

19. The control valve means of claim 11, wherein said trigger valve sleeve is received in said first bore of said support ring, therein being sealingly held with a radial flange, said auxiliary further comprising a third spool portion, wherein said trigger valve sleeve sealingly guides the third spool portion of said auxiliary valve spool, wherein a hollow space is arranged between said third spool portion and said trigger tappet, wherein a pressurized air bore extends axially completely through said auxiliary valve spool, said pressurized air bore communicating said control sleeve bore with said hollow space, and wherein said first spool portion of said auxiliary valve spool is cup-shaped and is engaging the annular gap between said support ring and said trigger valve sleeve.

20. The control valve means of claim 1, further comprising a sleeve having a cavity, and wherein the main valve spool has a larger spool portion and a smaller spool portion, the larger spool portion of said main valve spool being guided in the sleeve, the sleeve comprising a sealing edge for the smaller spool portion of said main valve spool when in the opening position, wherein in its closed position a gap between said main control spool and said sleeve connects a passage between the working chamber and the cavity in said sleeve, and wherein said cavity disconnected by the larger spool portion of said main valve spool with respect to the main control space is continuously connected through radial openings to atmosphere.

21. The control valve means of claim 20, further comprising a support ring, wherein said sleeve is received in a support ring.

22. The control valve means of claim 20, further comprising a support ring, wherein said support ring is defined to be a control valve module having a threaded portion for mounting.

23. The control valve means of claim 20, wherein said second effective area of said auxiliary valve spool is connected through a passage to said working chamber of said piston and wherein said passage includes a throttle.

24. The control valve means of claim 23, further comprising a support ring, wherein said support ring is defined to be a control valve module, wherein said throttle is located external of said control valve module.

* * * * *